US006062989A

United States Patent [19]

Wagner et al.

[11] Patent Number: 6,062,989

[45] Date of Patent: May 16, 2000

[54] ADJUSTABLE GOLF TEEING DEVICE

[76] Inventors: Jay S. Wagner, 116 Emerson Ct., Yorktown Heights, N.Y. 10598; Evan S. Wetzler, 104 Apple La., Briarcliff Manor, N.Y. 10510

[21] Appl. No.: 09/053,219

[22] Filed: Apr. 1, 1998

[51] Int. Cl.[7] ..... A63B 57/00

[52] U.S. Cl. ..... 473/386

[58] Field of Search ..... 473/386–403, 473/278, 417, 420, 479, 481, 173, 175; 248/346.03, 346.2

[56] References Cited

U.S. PATENT DOCUMENTS

| | | | |
|---|---|---|---|
| 2,079,387 | 5/1937 | Sickmiller | 473/398 |
| 2,470,574 | 5/1949 | Nelson | 473/394 |
| 3,216,681 | 11/1965 | Tagliavia | 248/346.03 |
| 3,516,664 | 6/1970 | Brennan | 473/402 |
| 3,858,879 | 1/1975 | Candor et al. | 473/417 |
| 4,176,838 | 12/1979 | Griffin | 473/417 |
| 4,516,780 | 5/1985 | Tabet . | |
| 4,664,374 | 5/1987 | Groves . | |
| 5,156,403 | 10/1992 | Martino | 473/396 |
| 5,242,161 | 9/1993 | Wilkirson . | |
| 5,351,964 | 10/1994 | Kruger . | |
| 5,672,122 | 9/1997 | Strong . | |
| 5,679,081 | 10/1997 | Santilli . | |

FOREIGN PATENT DOCUMENTS

| | | | |
|---|---|---|---|
| 2218341 | 11/1989 | United Kingdom | 273/32.5 |

*Primary Examiner*—Steven Wong
*Attorney, Agent, or Firm*—Lilling & Lilling P.C.

[57] ABSTRACT

An adjustable golf teeing device for use on a standard driving practice range which provides adjustment of golf tee height similar to conditions normally encountered on a natural golf course. The device consists essentially of a base and a vertically arranged hollow cylinder with an aperture at the top of the cylinder. The base of the device is placed under a standard mat found at a driving range with the hollow cylinder extending through an opening within the mat. A standard golf tee may be inserted into a moldable wax contained within the hollow cylinder which allows adjustment of golf tee height to the desired position.

19 Claims, 2 Drawing Sheets

FIG. 1
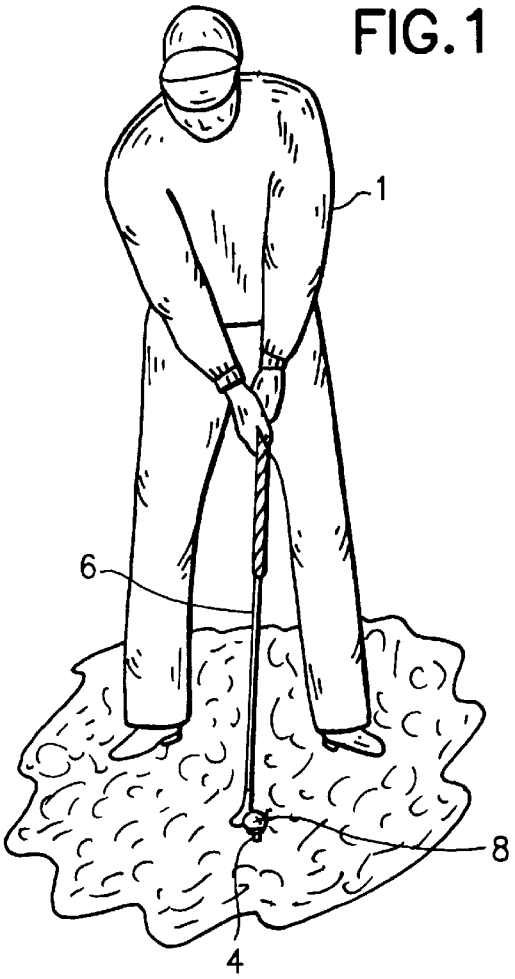
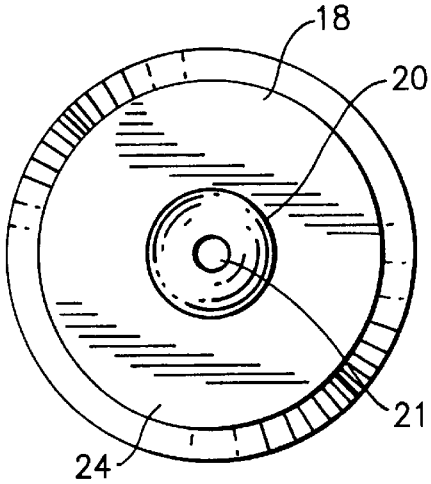
FIG. 3
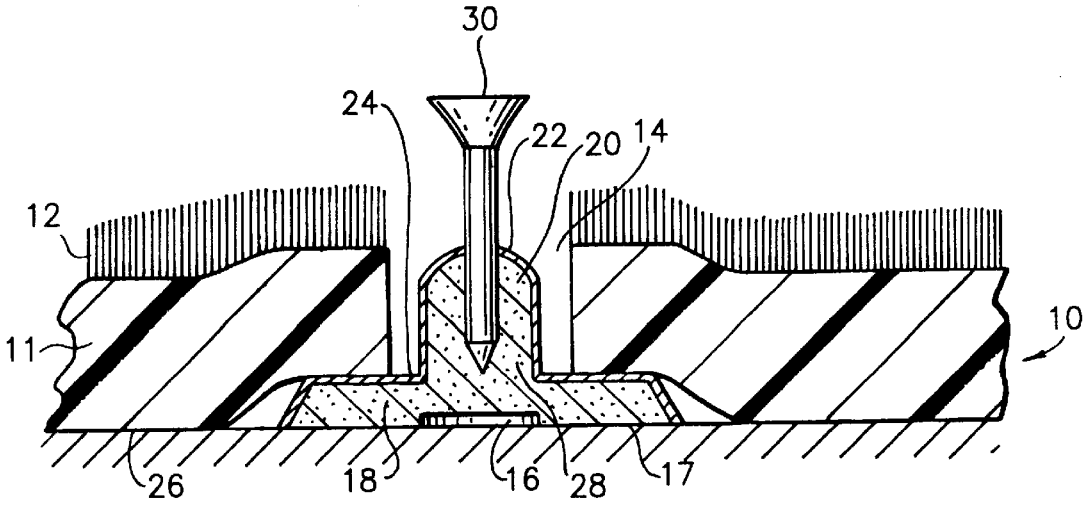
FIG. 2

ADJUSTABLE GOLF TEEING DEVICE

FIELD OF THE INVENTION

The invention relates to the golf industry and, in particular, to a device that may be used to adjust the height of golf tees at practice ranges.

BACKGROUND OF THE INVENTION

For more than a hundred years, golf has been a very popular sporting activity. Literally millions of Americans participate every weekend and entire vacations are centered around playing at well known courses.

One of the fascinating features of golf is its intricacy. In order to be proficient, a great deal of practice is required. Most golfers spend more time at the driving range and practice tee than in actually playing on a course.

A proper golf swing depends on a multiple of variables unique to each individual golfer, such as club length, the golfer's height, build and arm length and the placement of the golf ball in the tee box. On a natural golf course, the ball is elevated by placing a golf tee into the ground, upon which the golf ball is placed. The height of the golf ball in the tee box is thus determined by the height at which each individual golfer places the golf tee in the ground. Therefore, each golfer must determine what the precise optimal height of the ball is for his or her individual swing. Due to the many variables unique to each golfer, the tee height varies accordingly for each individual.

One of the problems with driving ranges and practice tees is that they typically do not provide practice tees of adjustable height. This necessarily limits the ability to simulate the conditions a golfer encounters on a natural golf course. Further, the golfer is unable to adjust the golf ball to an optimal height for his or her individual swing. Another problem with the prior art is that they typically do not provide practice tees having the feel of hitting a ball off a conventional tee.

While there are various adjustable golf ball tees on the market, none of them are suitable for use at a driving range or practice tee. At most such installations, a plastic mat of some sort is provided, with an artificial grass surface. Extending upward is a rubberized golf tee of a predetermined height.

Tabet (U.S. Pat. No. 4,516,780) discloses a peg with a pointed end for pressing into the ground. It is not suitable for use at a standard practice range. Internally within the peg is a sliding elongate member, which is held in the proper vertical position by a pin. The ball sits in a seat at the top of the elongate member.

Wilkirson (U.S. Pat. No. 5,242,161) discloses another device, which is not suitable for a standard practice range. It involves a base with multiple segments. The depth of entry of the golf tee is determined by the number of segments that are used.

As shown by Strong (U.S. Pat. No. 5,672,122), his device is useful on the course, but not typically at a driving range or practice tee. The tee itself is notched and fits into a disk. By proper alignment of the appropriate notch, the height of the tee can be adjusted.

Santilli (U.S. Pat. No. 5,679,081) discloses another adjustable tee that is for insertion into the ground. It includes a base with spikes for securement on the ground. Intermediate segments are added in order to determine the height.

Therefore, there is a need in the marketplace for an easy to use adjustable golf tee, that can be used at driving ranges to enhance the ability of the golfer to practice under conditions he or she would normally encounter on a natural golf course.

SUMMARY OF THE INVENTION

Accordingly, it is the object of this invention to allow the golfer to select various tee elevations when practicing at the driving range to simulate the ability to adjust the tee which a golfer would encounter on a natural golf course. In this way, each golfer may vary tee height at a driving range according to his or her individual preferences.

Still another object of this invention is to provide to the golfer practicing at the driving range the feel of hitting a ball off a conventional tee as he or she would encounter on a natural golf course.

The object is obtained by a simple, easy to use adjustable golf teeing device comprising a tee which may be adjusted at different heights within the invention. It comprises a base which is connected to a hollow vertical cylinder extending upward from the base. The base is placed under a mat at a driving range, the mat having an opening through which the vertical cylinder extends upward. Wax, or another pliable material, is inserted into the hollow cylinder through either a cap located on the bottom of the base or in the alternative an opening at the top of the cylinder. This permits a standard golf tee to be inserted at any appropriate depth into the wax within the hollow cylinder. By positioning the tee at various heights within the wax, a golfer can customize the height of the golf tee and therefore the golf ball itself. Further, the teeing device permits the tee to be deflected forward at impact having the feel of hitting a ball off a conventional tee. By placing a golf tee with a flat point at its lower end, wider then the tee stem, through an oval slot in the top of the cylinder, the golf tee is locked into the cylinder. This prevents the golf tee from coming out of the golf teeing device upon impact from the golf club. In an alternate embodiment a golf tee with a pin may be used. In this way, a golfer may use a single golf tee many times without the risk of the golf tee flying out of the devise and onto the driving range.

BRIEF DESCRIPTION OF THE DRAWINGS

FIG. 1 is a perspective view, illustrating a golfer in position for striking the golf ball.

FIG. 2 is a side view, in section, showing the golf tee support and the standard mat at the driving range.

FIG. 3 shows a top view of the golf tee support.

DETAILED DESCRIPTION OF THE INVENTION

Figure 4:
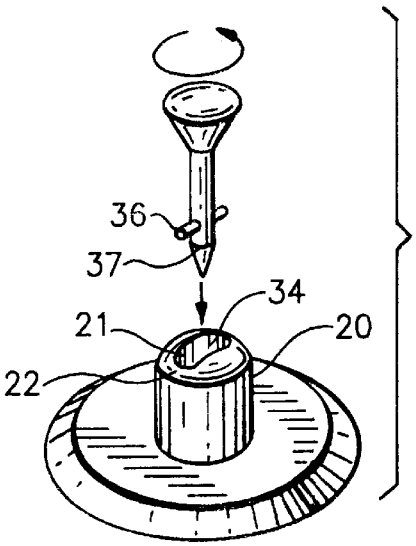
FIG. 4 is an exploded perspective view showing the manner in which the golf tee is inserted into the cylinder.
Figure 5:
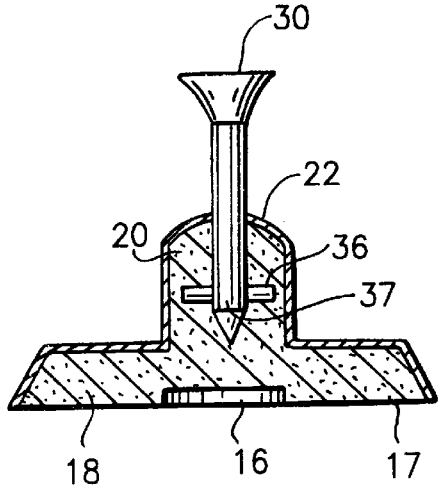
FIG. 5 is a side view, in section, showing the golf tee support and the golf tee with pin.
Figure 8:
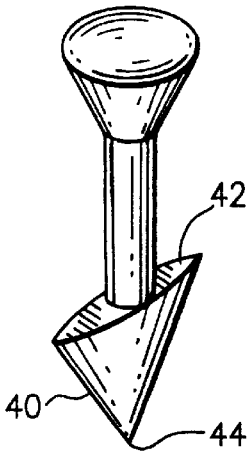
FIG. 8 is an exploded perspective view showing the golf tee having a flat point in the lower portion of the tee wider then the stem.
Figure 6:
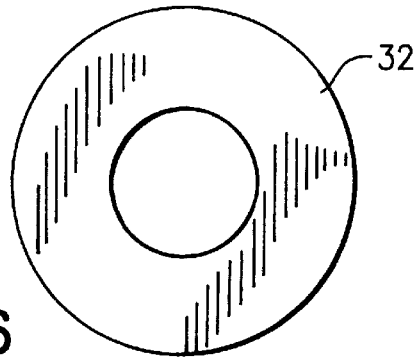
FIG. 6 is a top view of the spacer ring.
Figure 7:
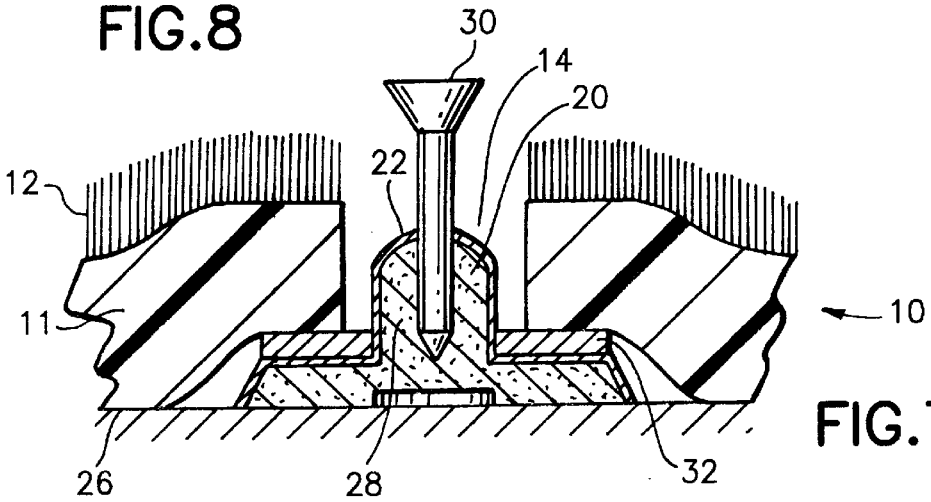
FIG. 7 is a side view, in section, showing the golf tee support, a spacer ring and the standard mat at the driving range.

As shown in FIG. 1, the golfer 2 positions himself with respect to the golf tee 4. This enables him to swing the golf club 6 and to address the golf ball 8 in the desired manner.

As golfers come in all different shapes and sizes, they necessarily have arms and legs of different length. Similarly, golf clubs come in many different lengths, depending on the size of the player. In order to optimize the practice swing, it is desirable to position the ball at an appropriate height that is distinct for each player.

At a standard driving range or practice tee, a plasticized mat 10 is used. Typically its upper surface is made of an artificial grass-like material 12 which is laminated to a lower layer 11 of foam-like material. The thickness of the mat will vary, but is generally about 15 mm to 25 mm in thickness. Its dimensions will vary, depending on the driving range or through wear from use. In many cases, a mat of about three feet square is used.

Within the mat, there is typically at least one through opening 14. This is for positioning of a standard rubber golf tee. In some arrangements, the mat may have multiple openings, so as to permit striking the ball from different positions on the mat.

The golf tee support of the invention includes a base 18 and a vertically arranged hollow cylinder 20 with an aperture 21 at the top of the cylinder. In some embodiments, the top of the cylinder will be in the shape of a dome so as to increase the structual strengh of the cylinder. Typically, the base 18 and the cylinder 20 will be made integral, as a single, unitary piece.

In the preferred embodiment, the golf tee support is fabricated from polyethylene. However, any light weight sturdy material may be used. The base can have any desired diameter, but generally must be wider then the through opening in the mat. In the preferred embodiment, a base diameter of 50 mm to 100 mm is used. It is found that such dimensions are adequate to provide stability for the invention and prevent it from being pulled through the opening 14 in the mat. In the preferred embodiment, a cap 16 will be in the center of the lower surface 17 of the base so as to allow access to the hollow area of the cylinder from the bottom of the adjustable golf tee. The hollow cylinder will be of a height, so that its upper surface 22 is preferably below the top surface 12 of the mat 10. In the preferred embodiment, the outside diameter is 15 mm to 22 mm and the inside diameter is 12 mm to 18 mm.

The mat can be lifted and the standard nonadjustable golf tee can be removed. Then, the golf support of this invention can be inserted with the hollow cylinder extending through the opening in the mat. The upper surface 24 of the base 18 braces against the undersurface 26 of the mat 10 to provide support. Though the cylinder can extend above the surface of the mat, in the preferred embodiments, the top of the cylinder remains slightly below the top surface of the mat. In this way, the golf club will not impact the cylinder when hitting the golf ball off the golf tee.

Inside the hollow interior of the cylinder 20, a soft, tacky, moldable wax 28, or other putty like or resilient material, is inserted. Preferably, the material fills the entire volume of the cylinder from the base to its top most surface. The resilient material is sufficient to permit removal and reentry of the golf tee for a significant number of times. In addition, the tacky material provides frictional grip on the golf tee, is remoldable and aids in stability. In the preferred embodiment a paraffin wax is used.

A conventional golf tee 30 can then be inserted into the material at any depth in order to provide any desired height of the golf tee. Because of the nature of the moldable wax, golf tees can be inserted and removed any number times, before the material loses its moldability and needs to be replaced. In the preferred embodiment, a polyethylene golf tee is used. While the golf tee may be made of wood, it could be disadvantageous, because such a tee could not be used as many times since it would break more readily.

In order to provide even greater adjustment for the device, a spacer ring 32 may be inserted over the hollow cylinder. This will serve to raise the mat with respect to the top surface of the hollow cylinder. It effectively permits the golf tee to be lowered even more with respect to the playing surface of the mat.

In some embodiments it may be desirable to shape the aperture 21 in the top 22 of the hollow cylinder 20 in the form of an oval so that it may act as a slot 34. Additionally, a golf tee may have a flat point 40 in the lower portion of the tee wider then the stem. The point forms a triangle at the bottom of the golf tee with its point 44 facing away from the head of the tee. In the alternative, a pin 36 may be placed at the lower portion 37 of the golf tee perpendicular to the stem of the tee and 5 mm–30 mm from the bottom of the golf tee. The slot is placed towards the target and in line with the shoulder of the golfer. When the golf tee is inserted into the wax within the cylinder, the tee is turned perpendicular to the slot. As a result, the golf tee is locked into the cylinder due to the upper portion 42 of the flat point engaging with the sides of the slot. In this way, the golf tee is stabilized in the wax and prevented from coming out of the cylinder upon impact by the club. The pin may be made separate or as part of the plastic mold of the golf tee.

The invention is described in detail with reference to a particular embodiment, but it should be understood that various other modifications can be effected and still be within the spirit and scope of the invention.

We claim:

1. An adjustable golf teeing device for accurately determining the vertical positioning of a golf ball to be struck by a golfer, comprising:

a golf tee support including a horizontally positioned base and a vertically extending hollow cylinder;

moldable material filling the hollow interior of said vertical cylinder; and a golf ball tee inserted into an interior mass of said moldable material to a desired height.

2. An adjustable golf teeing device according to claim 1, further comprising a support mat with an opening in which said vertical cylinder is positioned.

3. An adjustable golf teeing device according to claim 2, wherein the cylinder extends to a point below the surface of the mat.

4. An adjustable golf teeing device according to claim 1, further comprising a removable cap centrally positioned on a bottom of the base allowing access to the inside hollow portion of the cylinder.

5. An adjustable golf teeing device according to claim 2, further comprising a removable cap centrally positioned on a bottom of the base allowing access to the inside hollow portion of the cylinder.

6. An adjustable golf teeing device according to claim 1, wherein a top of the vertical cylinder is dome-shaped.

7. An adjustable golf teeing device according to claim 1, wherein a slot is defined in the top of the vertical cylinder.

8. An adjustable golf teeing device according to claim 1, wherein a flat point is positioned on the lower end of the golf tee thereby forming an inverted triangle wherein the apex faces away from the head of the tee and the base is wider than the stem of the tee.

9. An adjustable golf teeing device according to claim 1, further comprising a pin perpendicularly positioned on the lower end of the golf tee.

10. An adjustable golf teeing device for positioning in an upright position on a playing surface and for supporting a golf ball at a selected height above the the playing surface, comprising:

a mat resting on a playing surface and having a through opening;

a golf tee support member having a base that rests underneath said mat and a vertical cylinder positioned within said mat;

moldable material filling a hollow interior of said vertical cylinder; and a golf ball tee inserted into an interior mass of said moldable material to a desired height.

11. An adjustable golf teeing device according to claim 10, wherein a top of the vertical cylinder is dome-shaped.

12. An adjustable golf teeing device according to claim 10, wherein a slot is defined in the top of the vertical cylinder.

13. An adjustable golf teeing device according to claim 11, wherein a slot is defined in the top of the vertical cylinder.

14. An adjustable golf teeing device according to claim 10, wherein a flat point is positioned on the lower end of the golf tee thereby forming an inverted triangle wherein the apex faces away from the head of the tee and the base is wider than the stem of the tee.

15. An adjustable golf teeing device according to claim 11, wherein a flat point is positioned on the lower end of the golf tee thereby forming an inverted triangle wherein the apex faces away from the head of the tee and the base is wider than the stem of the tee.

16. An adjustable golf teeing device according to claim 10, further comprising a pin perpendicularly positioned on the lower end of the golf tee.

17. An adjustable golf teeing device according to claim 11 further comprising a pin perpendicularly positioned on the lower end of the golf tee.

18. An adjustable golf teeing device according to claim 14, wherein a slot is defined in the top of the vertical cylinder.

19. An adjustable golf teeing device according to claim 15, wherein a slot is defined in the top of the vertical cylinder.

* * * * *